US005347675A

United States Patent [19]

Tarrson et al.

[11] Patent Number: 5,347,675

[45] Date of Patent: Sep. 20, 1994

[54] TOOTHBRUSH

[75] Inventors: Emanuel B. Tarrson; Dane Maric; Lew Blahuta; Scott Koepsel, all of Chicago, Ill.

[73] Assignee: John O. Butler Company, Inc., Chicago, Ill.

[21] Appl. No.: 46,596

[22] Filed: Apr. 12, 1993

Related U.S. Application Data

[60] Continuation-in-part of Ser. No. 6,663, Jan. 19, 1993, which is a continuation of Ser. No. 875,627, Apr. 28, 1992, abandoned, which is a division of Ser. No. 575,229, Aug. 30, 1990, Pat. No. 5,201,091, which is a continuation-in-part of Ser. No. 475,724, Feb. 6, 1990, Pat. No. 5,027,467.

[51] Int. Cl.[5] ..... A46B 9/04

[52] U.S. Cl. ..... 15/167.1; 15/145; 15/176.5; 15/176.6; 15/206; 132/321; 403/397; 433/147

[58] Field of Search ..... 15/145, 167.1, 176.1, 15/176.4–176.6, 185, 206; 132/308, 311, 321, 329; 403/373, 397, 405.1; 433/147; 292/80, 87, 88

[56] References Cited

U.S. PATENT DOCUMENTS

| | | | |
|---|---|---|---|
| 2,556,500 | 6/1951 | Levine | 15/167.1 |
| 3,559,226 | 2/1971 | Burns | 15/167.1 |
| 3,909,050 | 9/1975 | Vicenoese et al. | 292/87 |
| 4,222,143 | 9/1980 | Tarrson et al. | 15/167.1 |
| 4,319,377 | 3/1982 | Tarrson et al. | 15/167.1 |
| 4,478,005 | 10/1984 | Munoschenk | 292/87 |
| 4,572,223 | 2/1986 | Rosenfeld | 15/167.1 |
| 4,710,996 | 12/1987 | Tarrson et al. | 15/167.1 |
| 4,751,761 | 6/1988 | Breitschmid | 15/176.5 |
| 4,780,923 | 11/1988 | Schultheiss | 15/167.1 |
| 4,805,252 | 2/1989 | Tarrson et al. | 15/167.1 |
| 4,850,074 | 7/1989 | Klevan | 15/167.1 |

FOREIGN PATENT DOCUMENTS

| | | | |
|---|---|---|---|
| 20268 | 12/1980 | European Pat. Off. | 15/185 |
| 2723643 | 11/1978 | Fed. Rep. of Germany | 292/87 |
| 334346 | 9/1936 | Italy | 15/176.1 |
| 150142 | 5/1955 | Sweden | 292/87 |
| 175973 | 6/1935 | Switzerland | 15/176.1 |

*Primary Examiner*—David A. Scherbel
*Assistant Examiner*—Mark Spisich
*Attorney, Agent, or Firm*—Laff, Whitesel, Conte & Saret

[57] ABSTRACT

An interdental toothbrush has a hinged locking retainer on the end of an elongated handle for capturing the stem of a twisted wire brush. The locking retainer has a hole which is adapted to receive the stem of a twisted wire brush. A land is formed in the handle adjacent the groove so that the wire brush stem is captured between that land area and a land area on the retainer. A latch on the locking retainer has a top end with a double cam surface thereon. One of the cam surfaces guides the latch into a locking position as the retainer is closed. The other of the cam surfaces releases the locking retainer when pushed.

9 Claims, 2 Drawing Sheets

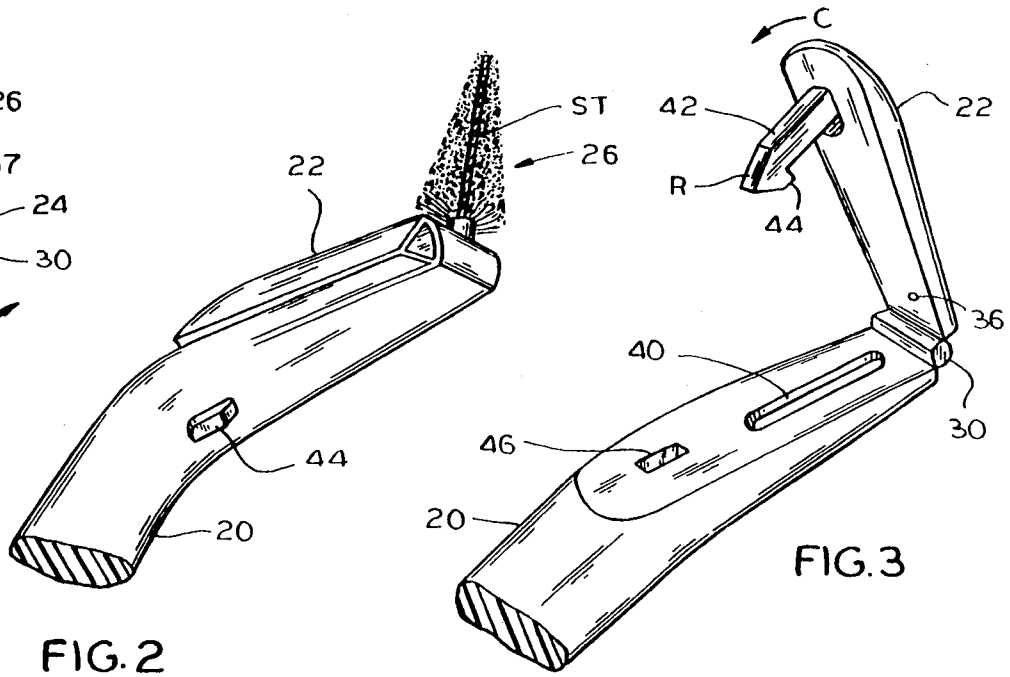
FIG. 3
FIG. 2
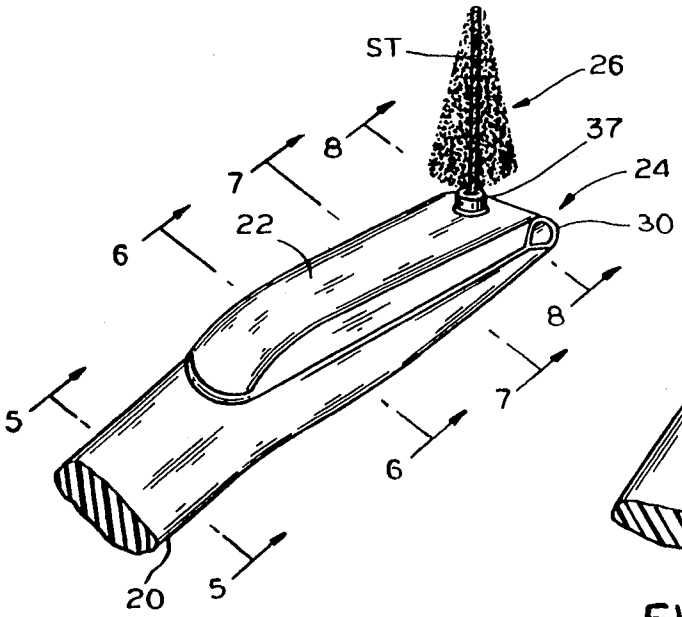
FIG. 1
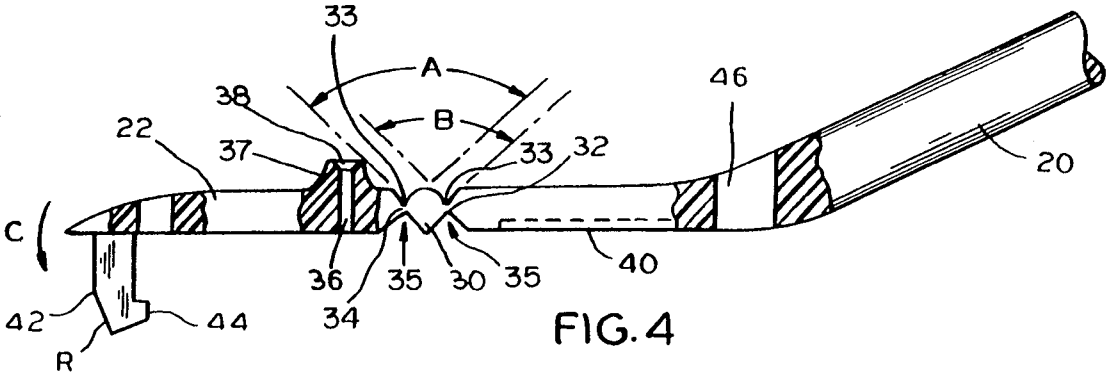
FIG. 4

TOOTHBRUSH

This is a continuation-in-part of Ser. No. 08/006,663, filed Jan. 19, 1993, pending; which was a continuation of Ser. No. 07/875,627, filed Apr. 28, 1992 (now abandoned); which was a division of Ser. No. 07/575,229, filed Aug. 30, 1990, U.S. Pat. No. 5,201,091 which, in turn, was a continuation-in-part of Ser. No. 07/475,724 filed Feb. 6, 1990 U.S. Pat. No. 5,027,467.

This invention relates to handles for interdental toothbrushes, and more particularly to toothbrush handles which have a lower cost and which, nevertheless, firmly and securely hold a twisted wire brush in place.

A number of U.S. patents show interdental toothbrushes: U.S. Pat. Nos. 3,559,226; 4,303,199; 4,222,143; 4,319,377; 4,572,223; 4,691,404; 4,710,996; 4,751,761; 4,780,923; 4,805,252; and 5,029,358.

A regular toothbrush is severely limited as to the tooth and gum surfaces that it can reach. One importance of brushing includes a cleaning of the tooth itself. However, it also includes a massaging of the gums and a cleaning of the sulcus or marginal area below the nominal gum line and between the tooth and gum. This massaging tends to thicken the gum tissue and to make it healthier.

As a result of these needs, it is common practice to provide a small twisted wire brush which may fit within and through the spaces between, around, and under teeth, bridges, and the like. This use of a twisted brush leads to two problems. One problem is to provide a brush which projects from a handle at approximately a right angle thereto. The other problem is to securely lock the brush in place at the lowest possible cost. The locking is a relatively severe problem since there is a substantial leverage acting upon the brushes. The low cost is also a relatively severe problem since the field of personal appliances, especially toothbrushes, is a highly competitive field.

In many countries, the custom and usage is to use very small diameter devices, such as toothpicks, for interdental cleaning. When the people in these countries use interdental brushes which are commonly used in the United States, they find the twisted wire too thick for their preference. Therefore, there is a need to provide an interdental brush with a very fine wire stem (in the order of 0.010-inch diameter wire).

Another consideration is the convenience for the user. Many people who have bridges or a large gap between their teeth, especially at the root line, are quite elderly. Their hands may be stiff, their eyesight impaired, etc. Thus, there may be many reasons why they find it difficult to use some of the prior art interdental handles where the brush stem has to be manipulated. Therefore, the ease of brush installation and replacement is also an important consideration.

The parent application Ser. No. 07/475,724 shows an improved locking arrangement for capturing the twisted wire brush. The parent application Ser. No. 07/575,229 provided an improved capturing of the twisted wire brush stem. The present invention provides a still further new and improved holding and locking device especially suited for a smaller diameter wire stem brush.

Accordingly, an object of the invention is to provide new and novel handles for interdental toothbrushes which are capable of holding twisted wire brushes having a range of wire diameters. Here, an object is also to reduce cost by making a single piece part which provides the above described features.

In this connection, an object of the invention is to provide a system wherein the brushes may be installed and replaced quickly and easily, even by a person having impaired eyesight and with less than completely normal facility to use their hands.

In keeping with an aspect of the invention, these and other objects are accomplished by providing an elongated toothbrush handle with a locking retainer hinged thereto by means of a living hinge. A hole in the retainer and a groove in the handle receive the twisted wire stem. A flat land of the handle material is positioned adjacent the groove. One only has to pass the twisted wire stem through the hole in the retainer and then close it. As the retainer closes, the wire stem is captured between the flat land of the handle and a flat land in the retainer, and the end of the stem is positioned within the groove. A latch on the retainer passes through a hole in the handle, with a positive capture latching. When the latch has so passed through the hole, the retainer is locked in place with the wire stem of the brush firmly held thereby. The top of the latch is shaped so that the twisted wire brush may be released by a push button convenience.

A preferred embodiment of the invention is shown in the attached drawings, wherein:

FIG. 1 is a perspective view of one side of the inventive toothbrush with the twisted wire brush in place;

FIG. 2 is a perspective view of the opposite side of the toothbrush of FIG. 1;

FIG. 3 shows the toothbrush handle without the twisted wire brush and with the locking retainer in a half open, half closed position;

FIG. 4 is a side elevation partly in cross section, of the toothbrush as it appears when it emerges from the mold;

Figure 5:
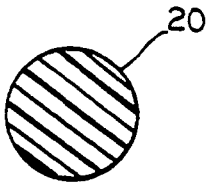
FIGS. 5–8 are cross-sections of the handle (without the brush) taken along lines 5—5; 6—6; 7—7; and 8—8, respectively, of FIG. 1.
Figure 6:
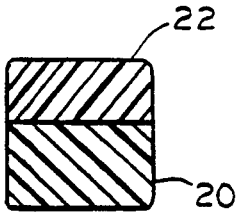
Figure 7:
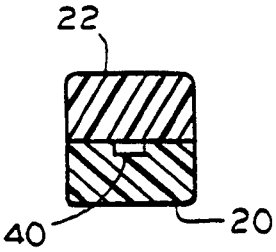
Figure 8:
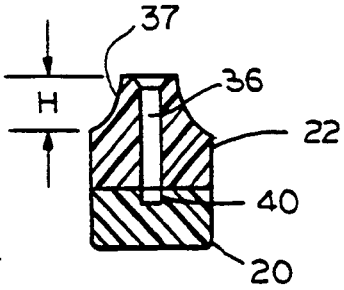

The inventive toothbrush is best seen in FIGS. 1–4, as comprising handle 20 having a locking retainer 22 joined thereto by a double living hinge at 24. A twisted wire brush is seen at 26. When the locking retainer 22 is closed over the handle 20, the brush is firmly locked in place.

The exterior contours of the handle with the locking retainer 22 closed over it are generally smooth with a blended curve so that there are no rough or projecting members which may catch or feel rough to the cheek or gum tissue. There is no need to provide any thumb nail notches or catches in order to facilitate an opening of the locking retainer since there is a novel push button opening mechanism.

The double living hinge 24 includes a member 30 (FIG. 4) having a generally triangular cross section with a 90° apex angle and joined on one side to the handle 20 by a thin membrane 32 and joined on the other side to the locking retainer 22 by a thin membrane 34. The thin membranes 32, 34 function as the living hinge on which the locking retainer 22 and handle 20 move relative to each other. The membranes 32, 34 are formed at the roots 33 of angles A, B by radiusing a mold at about 0.005-inch. The opposite side of the handle has two sharp indentations, as at 35, which together form triangular member 30 and which define the undersides of living hinges 32, 34.

The locking retainer 22 has a projecting chimney-like member 37 with a hole 36 formed therein for receiving the stem ST of a twisted wire brush. The outer end of the hole 36 is chamfered or beveled at 38 in order to form a funnel-shaped opening for guiding, directing, and receiving the end of the twisted wire brush, to facilitate an insertion thereof. Therefore, wire stem ST projects through hole 36 to be bent over to lie in the groove 40.

A groove 40 is formed preferably in the handle 20 at a location which is aligned with the hole 36. The hole 36 and groove 40 may also be at reversed locations in a slightly redesigned handle. The end of the wire stem ST engages the retainer 22 and is guided to bend and enter groove 40. The twisted wire brush stem ST is thus trapped automatically in groove 40 when the locking retainer 22 is closed, (swung in direction C).

When the locking retainer 22 is locked in a closed position, the wire stem ST is located and locked in position within both the hole 36 and the groove 40. At this time the wire stem ST is bent to have a somewhat L-shape, with one arm of the "L" locked in groove 40 and the other arm of the "L" passing through the hole 36. The brush is on the opposite end of the stem arm which passes through hole 36.

Figure 9:
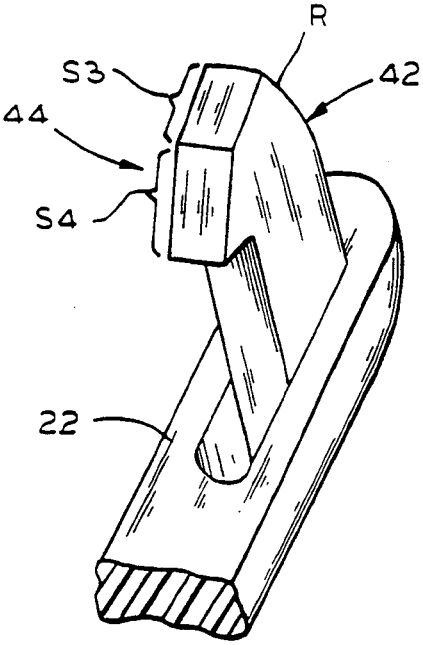
FIG. 9 is a perspective view of a push button latch mechanism.

The locking retainer 22 includes an upstanding latch 44 (FIG. 9). A corresponding keeper hole 46 (FIG. 3) is positioned in the handle 20 at a point which the latch 42 engages as the locking retainer 22 swings from an open to a closed position. Once the latch 42 clears the far side of the keeper hole 46, the locking retainer 22 is locked into position. As seen in FIGS. 2, 9 the latch edge 44 on the top of latch 42 and at the far end of keeper hole 46 is a double cam which both helps latch and acts as a push button which may be pushed in order to help initiate an opening of the retainer.

Figure 10:
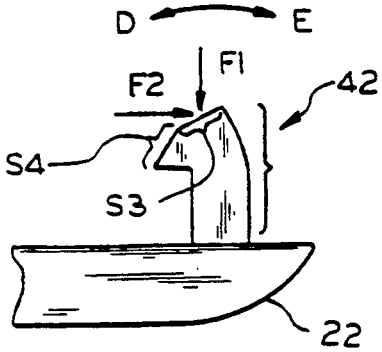
FIG. 10 is a side elevation of the same push button latch mechanism.

The action of the latch 42 may be best understood from a review of FIG. 10. Latch 42 comprises a shaft topped by a double cam formed by two beveled surfaces S3, S4. The shaft is flexible enough to flex back and forth in directions D, E, as the shaft enters and leaves keeper hole 46. The first cam or beveled surface S4 causes the shaft to flex in direction E as it encounters the perimeter of the keeper hole 46. The memory of the plastic is such that after latch 44 passes through keeper hole 46, the latch 42 returns in direction D, engages and locks over the far edge of the handle 20 (FIG. 2) at the perimeter of keeper hole 46.

When the user wishes to release the locking retainer 22, he holds handle 20 in his hand and presses against surface S3, preferably with his thumb nail. As shown in FIG. 10, the downward pressure of the user's thumb nail acts on the second cam or beveled surface S3 to exert a downward force F1 against the top of the shaft. This downward force acts on the cam formed by sloping top S3 of latch 42 to produce a horizontal vector F2 which flexes the shaft in direction E. As the shaft so flexes, the latch 42 moves away from the capture position over the far side of the handle 20 and passes through the keeper hole 46, thus releasing the locking retainer 22. It should be noted that the back of the latch 42 has a slanted relief area R which enables the latch shaft to move back and forth in directions C,E, while in the keeper hole 46.

The construction of the toothbrush handle may become more apparent from a study of FIGS. 5–8, which are four cross sections taken at locations identified in FIG. 1. As shown in FIG. 5, above the locking retainer 22 (section line 5—5), the handle is simply a solid piece of molded plastic, of any suitable geometric configuration (here circular cross-section).

At the latching end (section 6—6), the locking retainer 22 (FIG. 6) and the handle together form a smooth and substantially uninterrupted contour which does not irritate the gum, cheek or other soft tissue inside the mouth. That is, since the latch 42 opens with a push button action, it is not necessary to provide an opening or thumb nail catch at the parting line between handle 20 and locking retainer 22. Such a catch might irritate the soft mouth tissue for people.

Further down the handle (section 7—7) toward the hinged end 24, the locking retainer 22 (FIG. 7) and handle 20 have substantially the same dimensions to continue the smooth irritation free contour. At this point, the groove 40 forms a locking area for receiving the end of the twisted wire stem ST when the locking retainer 22 is latched in a closed position. Still further down the handle (Section 8—8), the retainer is formed into a chimney 37 or extension having a height H which further helps stabilize the twisted wire stem ST. Preferably, the height H extends far enough to reach the bristles of the brush, thus lessening any tendency for the wire stem to bend, at random, during the use thereof.

Figure 11:
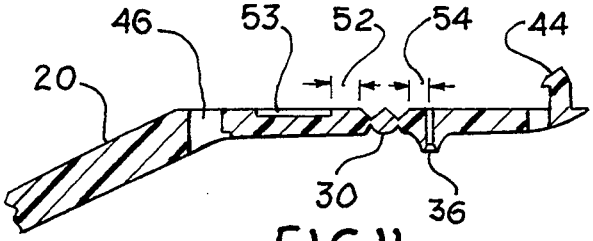
FIG. 11 is a similar cross section of a toothbrush handle, especially for a very fine stem brush, but also usable with a wire stem of any suitable diameter.

In the new brush handle of this invention (FIG. 11), a pair of lands 52, 54 are provided. The land 52 is approximately 0.042- inches wide in one embodiment. The wire stem emerging from hole 36 engages the flat land 52 and is gripped between the two flat surfaces 52, 54 in the vicinity of hole 36. Beyond lands 52, 54 the stem fits into groove 53 which gives a stability and keeps the end of the wire stem from swinging back and forth in the plane of the surface containing groove 53.

Those who are skilled in the art will readily perceive how to modify the invention. Therefore, the appended claims are to be construed to cover all equivalent structures which fall within the true scope and spirit of the invention.

We claim:

1. A toothbrush for holding a twisted wire brush, said toothbrush comprising an elongated handle member having a hinged locking retainer at an end thereof, one of said locking retainer and said handle having a latch, the other of said locking retainer and handle having a keeper hole which is complementary to said latch, said latch entering said keeper hole when said locking retainer is swung on said hinge to a closed position on said handle member, said locking retainer and handle having smooth and substantially uninterrupted contours when closed, a projecting chimney having a hole formed in one of said handle and said locking retainer near said hinged end, said chimney hole having a dimension for receiving and holding a stem of a twisted wire brush, a groove formed in the other of said handle and said locking retainer, said groove having a dimension for receiving and holding said twisted wire stem, and at least one flat land area surface on a respective one of said locking retainer and said handle, said at least one land area being located between said chimney hole and said groove, said groove extending from said at least one land area and from a point near but not opposite said chimney hole when said retainer is closed, when closed said retainer and handle presenting said at least one flat land area surface between said hole and said groove in order to grip said stem.

2. The toothbrush of claim 1 wherein said one of said handle and locking retainer has a protrusion which extends outwardly from said retainer to form a somewhat chimney-like extension of said chimney hole for stabilizing and reinforcing the stem of said wire stem.

3. The toothbrush of claim 1 wherein said hinged end has a member with a triangular cross section separating two living hinges for joining said member to said handle and to said locking retainer respectively.

4. A toothbrush for cleaning interdental spaces, said toothbrush comprising a handle having a living hinge joining a locking retainer to an end thereof, said locking retainer closing over said handle, said handle and locking retainer having complementary contours forming a latching means for latching them together when closed, and a hole extending through said retainer, said hole confronting a flat land surface on said handle when said retainer is closed over said handle, and a groove in said handle extending away from said flat land surface, the stem of a twisted wire brush extending through said hole and forming a substantially L-shape to fit into said groove, said groove having an alignment that holds the stem of said twisted wire brush to restrain a swinging of the end of said stem.

5. The toothbrush of claim 4 and a chimney-like extension associated with said hole for tending to preclude a bending of said wire stem when said brush is in use.

6. The toothbrush of claim 4 wherein said L-shape of said twisted wire stem forms automatically responsive to a closing of said locking retainer over said handle.

7. The toothbrush of any one of the claims 1–4 wherein the toothbrush is adapted to be used with a twisted wire brush having a stem diameter in the order of 0.010-inches.

8. The toothbrush of any one of the claims 1–4 wherein said at least one land is approximately 0.042-inch wide.

9. An interdental toothbrush having a handle with an end joined to an integral brush locking retainer by a living hinge, a hole in one of said handle and said retainer for receiving a stem of a twisted wire brush, said stem bending into a substantially L-shape when said retainer folds at said living hinge and closes over said handle, a groove in the other of said handle and said retainer, an end of said bent stem being gripped between two flat surfaces on said retainer and handle respectively and then fitting into said groove when said retainer and said handle come into a closed position, said flat surfaces being spaced from a respective one of said groove and hole and further wherein one of said flat surfaces confronts said hole when said retainer is closed over said handle, and means comprising a latch and keeper for releasable locking said retainer and handle in said closed position.

* * * * *